US011639254B2

(12) United States Patent
Wierzbicki

(10) Patent No.: US 11,639,254 B2
(45) **Date of Patent: *May 2, 2023**

(54) DRINKING SPOUT WITH TRIGGER AND VALVE MECHANISM FOR BOTTLES AND CANS

(71) Applicant: Peter C. Wierzbicki, San Bruno, CA (US)

(72) Inventor: Peter C. Wierzbicki, San Bruno, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/903,524

(22) Filed: Sep. 6, 2022

(65) Prior Publication Data

US 2022/0411142 A1 Dec. 29, 2022

Related U.S. Application Data

(63) Continuation of application No. 17/015,436, filed on Sep. 9, 2020, now Pat. No. 11,511,917.

(60) Provisional application No. 62/900,425, filed on Sep. 13, 2019.

(51) Int. Cl.
*A47G 19/22* (2006.01)
*B65D 47/26* (2006.01)

(52) U.S. Cl.
CPC ..... *B65D 47/266* (2013.01); *A47G 19/2272* (2013.01); *B65D 47/268* (2013.01)

(58) Field of Classification Search
CPC .... B65D 47/266; B65D 47/268; B65D 47/32; B65D 47/248; B65D 2543/00046; B65D 43/02; B65D 51/18; A47G 19/2272; A47G 19/2266; A47G 19/225; A47G 19/2227; A47G 23/16; A45F 3/16
USPC ..... 215/311, 387, 19; 222/470
See application file for complete search history.

(56) References Cited

U.S. PATENT DOCUMENTS

| | | | | |
|---|---|---|---|---|
| 2,116,966 | A | 5/1938 | Barlow | |
| 4,305,515 | A | 12/1981 | Tontarelli | |
| 4,946,079 | A | 8/1990 | Campbell | |
| 5,199,597 | A | 4/1993 | Gladish | |
| 5,273,172 | A | 12/1993 | Rossbach et al. | |
| 6,260,731 | B1 * | 7/2001 | Cummings | A45F 5/02 220/717 |
| 6,877,626 | B2 | 4/2005 | Sherrod | |
| 7,993,518 | B2 | 8/2011 | Shani | |
| 8,573,445 | B2 | 11/2013 | Murray | |
| 8,978,923 | B2 * | 3/2015 | George | B65D 43/0225 215/311 |
| 9,079,205 | B2 | 7/2015 | Hoskins | |
| 9,908,687 | B2 | 3/2018 | Chiou | |

(Continued)

*Primary Examiner* — King M Chu
(74) *Attorney, Agent, or Firm* — Bold IP, PLLC; Binita Singh

(57) ABSTRACT

A bottle comprising a bottle spout manufactured into the bottle that provides for an uninhibited, full-flow of beverage which has a user-initiated trigger and valve mechanism that can be activated in a single motion with one hand and which closes automatically when the user-initiated trigger is released. The bottle spout comprises a housing with a drinking end and a bottle connector end, a valve that is connected to an external trigger by a spring-loaded recoil mechanism, and a safety lock to prevent accidental opening of the valve. The bottle with the bottle spout may also comprise a carry clip and ergonomic features for ease of carrying and holding, respectively.

20 Claims, 5 Drawing Sheets

(56) References Cited

U.S. PATENT DOCUMENTS

| | | | | |
|---|---|---|---|---|
| 2011/0151069 | A1 | 6/2011 | Harding | |
| 2011/0309095 | A1* | 12/2011 | Pinelli | B65D 47/32 220/715 |
| 2011/0309280 | A1 | 12/2011 | Wincek | |
| 2014/0353275 | A1 | 12/2014 | Hung | |
| 2015/0115189 | A1 | 4/2015 | Jung | |

* cited by examiner

DRINKING SPOUT WITH TRIGGER AND VALVE MECHANISM FOR BOTTLES AND CANS

CROSS REFERENCE TO RELATED APPLICATION

This application is a continuation application and claims benefit of Non-Provisional application Ser. No. 17/015,436 filed on Sep. 9, 2020, which claims benefit of U.S. Provisional Application No. 62/900,425 filed on Sep. 13, 2019, which are incorporated by reference in their entirety.

TECHNICAL FIELD

The overall field of this invention is directed to a closure for drinking receptacles and more particularly to a trigger-activated valve opening and automatic closure for intermittent drinking of beverages and preventing spillage.

BACKGROUND

Bottled and canned beverages are in common use today. Users drink from these vessels under a wide variety of circumstances in which the beverages are likely to be spilled and can create dangerous situations. Users also drink the beverages in situations where they are driving a vehicle and two hands are needed to open the cap, which creates a potential for accidents due to operator distraction and losing control of the vehicle when both hands are removed from the steering wheel of the vehicle.

There are a variety of bottle caps on the market designed for drinking and sealing the container with the beverage. Some require their own integrated beverage container. Most require two-handed operation for both opening and closing and very few actually attach to standard commercial beverage bottles. A proposed solution to fit commercial bottles involves a cap having multiple bottle thread geometries that has a flow-limiting, nipple-shaped nozzle which opens, and closes based on the trajectory of the bottle. This solution discloses mouthpieces such as nipples, pacifier, sippy cup, flip top, and mouthpieces that involves inhibited flow of the beverage.

However, none of the existing devices allow for an uninhibited, full-flow drinking spout which has a user-initiated trigger and valve mechanism which can be activated in a single motion with one hand while picking up the beverage, close automatically when releasing the trigger or dropping the bottle, and can be attached to or built-in to industry standard bottles and cans. Thus, there still exists a need for such an improved device.

SUMMARY

The present disclosure recognizes the unsolved need for an uninhibited, full-flow bottle spout which has a user-initiated trigger and valve mechanism which can be activated in a single motion with one hand while picking up the beverage, and which also is capable of closing automatically when the user-initiated trigger is released or the bottle is set down or dropped.

The bottle spout, as disclosed in one or more non-limiting embodiments described in this document, can be attached to or built-in to industry standard bottles and cans. In this respect, the one or more embodiments of a bottle spout may be described as a universal attachment means that beneficially can attach to a variety of commercial bottles or cans that have different neck and thread sizes. Attachment of the bottle spout to various bottle types can be achieved by matching the threads of the male bottle neck to the female bottle connector of the spout. In cases where the bottle has no threads, such as may be the case with some beer cans and some wine bottles, or other types of containers, a stretchy rubber coupler may be used, whereby the stretchy rubber coupler is configured to fit snuggly over the bottle's opening by simply applying pressure and pushing the rubber coupler over the neck of the bottle. Additionally, in some embodiments, multiple bottle sizes and types can be fitted with a single sleeve attachment.

In one or more embodiments, the bottle spout is comprised of a housing which has the rubber coupler configured to one end and the other end of the housing is configured with an orifice and a lip. The orifice with the lip is the drinking end of the drinking spout. Within the housing, the bottle spout is comprised of a valve that covers the orifice and a spring-loaded mechanism to move the valve and uncover the orifice completely. A trigger is configured on an exterior of the housing and is connected to the spring-loaded mechanism that moves the valve to uncover the orifice. The spring-loaded recoil mechanism allows the valve to automatically move back to cover the orifice. To prevent accidental opening of the valve, the bottle spout is also configured with a locking mechanism which is designed to interrupt the movement of the mechanism that moves the valve. Additionally, the bottle spout is also comprised of a carry clip and an ergonomic design for one-handed holding and opening of the valve.

In the preferred embodiment, the bottle spout is designed to be comprised of a valve that can be selected from and is not limited to a semi-ball valve, ball valve with a hollow core to provide full flow of the beverage, an upward opening wafer valve, a downward opening wafer, downward, and a slider valve.

DETAILED DESCRIPTION

Figure 1A:
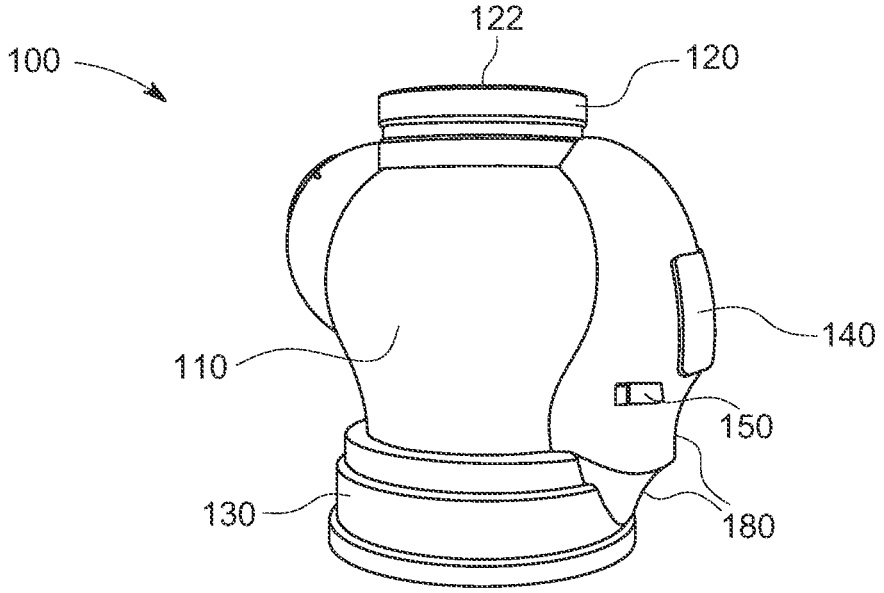
FIG. 1A is a perspective view of an exemplary embodiment of a bottle spout.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any item(s), so a "set of items" may indicate the presence of only one item or may indicate more items. Thus, the term "set" may be equivalent to "one or more" as used herein.

The present disclosure describes a universal bottle spout that can be attached to a beverage container, in particular to existing industry standard beverage containers. In a non-limiting preferred embodiment, the bottle spout is designed to be capable of mounting to multiple bottle types. These industry standard beverage containers may include bottles such as, and not be limited to threaded and non-threaded water bottles, soda bottles, and beer bottles. In alternative embodiments, the bottle spout is also designed to be capable of mounting to a single bottle type such as, and not limited to a wine bottle or a beer bottle. Further alternative embodiments are specific to other existing industry standard beverage containers such as, and not limited to cans, wide-mouth tea and health drink bottles, soda and coffee cups, corked champagne bottles, and non-threaded wine bottles. Alternatives also include other industry non-standard beverage containers, such as and not limited to custom beer, wine and coffee bottles, and sport bottles. The bottle spout would be fashioned from material including and not limited to aluminum, plastic, stainless steel, glass, wood, or a combination of materials.

In the preferred embodiment, the bottle spout is comprised of a housing which includes a bottle connector coupler on one end and a drinking orifice lip on the other end. The bottle connector coupler is designed as a universal connector such that it includes two different threads and a rubber sleeve so that the bottle spout of the preferred embodiment is capable of connecting to several different bottle types as enumerated above. The bottle spout is further comprised of a valve which is housed within the housing. A trigger is configured on the exterior of the housing to move the valve away from the orifice and is connected to the valve via a spring-loaded mechanism. The bottle spout is comprised of a safety feature to prevent accidental opening by utilizing a sliding lock. Additionally, the bottle spout also includes a carry clip and has an ergonomic design comprised of a thumb rest and at least a finger rest.

In the preferred embodiment, the housing has a first end and a second end. The first end is open and is comprised of the drinking orifice lip and the second end is comprised of the bottle connector coupler. The drinking orifice lip is the end from which a user drinks the beverage and is thus designed with a smooth rounded edge for the user to comfortably place their mouth. The bottle connector coupler is designed so that it can be connected to the industry standard bottles by the user. In the preferred embodiment, the bottle connector coupler is designed to be a universal connector such that it can be connected onto several different bottles types and is thus reusable. The connection means on the bottle connector coupler is comprised of at least two different female threads and a rubber sleeve. The two different female threads conform to the male threads on most commercially available bottles. The rubber sleeve is a stretchy rubber coupler at the bottom of the bottle connector coupler which is slipped onto and stretched over an opening of a commercially available bottle and allows the bottle spout to fit snugly over the bottle opening. The advantage of having a rubber coupler as part of the bottle connector coupler is that it allows the bottle spout to be connected to non-threaded commercially available bottles.

The housing coupler is comprised of an internal chamber which is configured within the housing coupler. The internal chamber is designed to be hollow and traverses the length of the housing coupler from the first end to the second end. The internal chamber is open from the first end with the orifice lip to the second end with the bottle connector coupler which connects to the commercial bottle. The internal chamber is designed to allow a full flow of beverage from the connected commercial bottle through the internal chamber to the open first end with the orifice lip.

In the preferred embodiment, the open first end of the housing coupler is closed by way of the valve and is connected to the trigger, which is located externally on the housing. The valve is located within the internal chamber of the housing and is connected to the trigger through a spring recoiled mechanism. The valve is generally located near the open first end but is configurable anywhere within the internal chamber depending on the type of valve utilized that allows a particular valve to function properly. The valve is generally in the closed position, which is that the valve is preventing the flow of a beverage out through the orifice of the bottle spout. The mechanism to open the orifice on the bottle spout starts with a user depressing the trigger (e.g., using a finger), which in turn activates the motion that displaces the valve from the opening to then allow the beverage to flow uninhibited through the internal chamber and out the orifice of the bottle when the user arranges to drink. Applying the pressure on the trigger also causes the recoil spring to be compressed. While the pressure is placed on the external trigger by the user, the valve remains displaced leaving the orifice open. Removing the finger off the trigger removes the pressure, and the recoil spring decompresses and causes the automatic return of the valve over the orifice, essentially following the opposite movement of the displacing of the valve.

The bottle spout is also comprised of the safety lock mechanism. A preferred embodiment of the safety lock mechanism is comprised of a rotating disc on an axle. Depending on the type of valve used, the rotating disc includes a pin that extends vertically upward from the disc or alternatively a pin that extends horizontally outward from the pin. The safety mechanism is configured to be positioned near the trigger such that a part of the disc extends out from the housing coupler and with the axel and pin positioned inside the housing. To activate the lock, the disc is manually rotated counterclockwise which rotates the pin on the disc to be positioned against the trigger on the inside of the housing and thus blocking the trigger from being pushed inward. To unlock, the disc is rotated in the opposite direction, clockwise, to rotate the pin away and unblocking the trigger.

The carry clip is also integrated onto the exterior surface of the housing coupler and comprises part of the bottle spout. The functionality is much like a traditional bent clip, such as a carabiner, and allows the user to quickly attach the bottle spout (connected to the commercial bottle) to items to make it easy to carry. The carry clip is designed to be smoothly integrated into the exterior of the housing coupler. The carry clip has a gate, which is the part that opens, and snaps shut. The exterior of the housing where a top end of the gate is connected to and is opposite the gate is a spine. The gate snaps into a nose of the carry clip and is the portion that closes the loop. Generally, the user would press into the gate toward the spine to push the gate away from the nose. The user would then hook the bottle spout to an item by slipping the space created by pushing the gate away from the nose. Releasing the gate would allow the gate to snap back to the nose and away from the spine.

The bottle spout also utilizes an ergonomic design. The bottle spout is designed to be used with one hand. The ergonomic attributes include and are not limited to a thumb rest on a side opposite the trigger, at least one finger rest designed below the trigger, and a smooth orifice lip. This design allows the user to comfortably hold the bottle spout with the connected commercial bottle and activate the valve mechanism in a single motion with the same hand. The bottle spout can also be configured with a variety of grips and handles that conform to and adapt the basic need of a full-flow drinking spout which has a user-initiated trigger and valve mechanism which can be activated in a single motion with one hand while picking up the beverage, and which closes automatically when the user-initiated trigger is released.

The bottle spout can be equipped with a variety of valve types including and not limited to a semi-ball valve, a ball valve, a slider valve, a wafer valve that opens downward, a wafer valve that opens upward, and other valves that can be accommodated and fitted within the internal chamber of the bottle spout. The valves above are described in more detail as examples of valves incorporated in the housing to illustrate the function and advantage of the bottle spout.

In the first example, the valve comprising a part of the bottle spout is in the shape of a semi-ball and is referred to as a semi-ball valve in this disclosure. The advantage of the semi-ball being that it provides more space within the internal chamber for the mechanical components of the spring recoiled mechanism that displaces and replaces the valve at the open first end.

The semi-ball valve functions to cover the opening to the orifice from within the internal chamber of the housing. The valve is connected to the trigger through a spring recoiled mechanism. The spring recoiled mechanism is comprised of the semi-ball valve connected to a rod, referred to as a valve rod. The valve rod has a central axle, which is located generally near the center of the valve rod. The trigger is connected to a shaft, referred to as a plunger shaft. The plunger shaft is wrapped around with a recoil spring. An end of the plunger shaft opposite the trigger is connected to another shaft, referred to as a linkage arm. The linkage arm connects to the valve rod, and thus may be thought of as connecting the trigger to the semi-ball valve. The two ends of the linkage arm are connected to the valve rod and the plunger shaft via a pair of linkage pins, one at each end.

To activate the rotation to open the orifice on the bottle spout, the trigger is depressed, which forces the connected plunger shaft inward. When the user presses on the trigger with a finger, the inward motion of the plunger shaft pushes on the linkage arm and deviates the angle at the linkage pin connecting the plunger shaft to the linkage shaft and further causing the linkage arm to move upward. This upward movement deviates the angle at the linkage pin connecting the plunger shaft to the valve rod which causes the valve rod to rotate at the central axle which rotates the semi-ball valve away from the orifice of the bottle spout. Applying the pressure on the trigger also causes the recoil spring to be compressed. While the pressure is placed on the trigger by the user, the semi-ball valve stays displaced from the orifice. Removing the finger off the trigger removes the pressure, and the recoil spring decompresses and causes the automatic return of the semi-ball valve over the orifice, essentially following the opposite movement of the valve rod, the linkage shaft, and the plunger shaft.

The safety lock mechanism in this example is comprised of the rotating disc on an axle as described earlier. In this example of a bottle spout comprised of the semi-ball valve, the rotating disc is provided with a pin that extends vertically upward from the disc. As described above, the safety mechanism is positioned near the trigger such that a part of the disc extends out from the housing coupler and with the axle and pin positioned inside the housing. The lock is activated when the disc is manually rotated counterclockwise, which rotates the pin on the disc to be positioned behind the trigger on the inside of the housing and thus blocking the trigger from being pushed inward. To unlock, the disc is rotated in the opposite direction, clockwise, to rotate the pin away and unblocking the trigger.

Another example of a valve that can be incorporated within the housing of the bottle spout is the rotating ball valve. The rotating ball valve is housed within a spherical internal chamber of the housing coupler. The internal chamber is designed to accommodate the ball valve snugly which creates a tight seal, but at the same time allows the ball valve to rotate within the internal chamber. The internal chamber wall is open on the two ends of the housing coupler, the first end and the second end, which are open to the orifice and the bottle housing coupler, respectively. The ball valve is comprised of a hollow core which traverses through the middle of the ball valve. The hollow core is designed to be approximately the same diameter as the openings in the two ends of the internal chamber wall which are approximately the same diameter as the orifice. When the openings in the hollow core of the ball valve and the openings in the internal chamber align with each other, it provides an uninhibited free flow of the beverage from a connected commercial bottle.

The ball valve generally rests in a closed position, which is when the hollow core is not aligned with the openings in the internal chamber wall and is relatively perpendicular to these openings. In this configuration, the ball valve provides a tight seal to prevent the flow of the beverage through to the orifice of the bottle spout. Other advantages of the ball valve include that the tight seal prevents spillage, loss of effervescence, and contamination of the beverage.

The ball valve utilizes a spring recoil mechanism that rotates the ball and automatically returns it to the closed position. The ball valve is adapted with and rotates on an axle, which will be referred to as a ball axle. The ball axle is integrated with a pair of coil springs, one on each side of the ball valve. A trigger is connected to the ball valve such that a pair of linkage arms extend from the trigger and connect to the axle. The trigger is a flat piece that extends outward through an opening in the housing coupler. The housing coupler is designed with a slot that extends downward from the opening for the trigger. The slot may be described as an open section which can accommodate a downward movement of the trigger. The trigger is pressed down along the slot which rotates the ball axle via the connected linkage arms which in turn rotates the ball valve to the position which aligns the hollow core of the ball valve with the openings in the internal chambers, the connected commercial bottle, and the opening at the orifice. In this position, the user is capable of drinking the beverage from the bottle spout with an uninhibited, full flow. Releasing the pressure off the trigger returns the ball valve into the closed and tightly sealed position via the action of the coil springs on each end of the ball axle.

The safety lock mechanism is comprised of the rotating disc on an axle as described earlier. In this example of a bottle spout comprised of the ball valve, the rotating disc is provided with a pin that extends horizontally outward from the disc. The safety mechanism is configured similarly where it is positioned near the trigger such that a part of the disc extends out from the housing coupler and with the axle and pin positioned inside the housing. The lock is activated similarly where the disc is manually rotated counterclockwise which rotates the pin on the disc to be positioned under the trigger on the inside of the housing and thus blocking the trigger from being pushed downward. To unlock, the disc is rotated in the opposite direction, clockwise, to rotate the pin away and unblock the trigger.

Another example of a valve that can be implemented in the bottle spout includes a slider valve. The slider valve is fashioned as a flat plate and includes an opening on one side that is the same shape and diameter as the opening in the internal chamber. An trigger is connected to the slider valve on the side that has the opening. The portion of the slider valve connected to the trigger sits within a chamber, referred to as slider trigger chamber. The other side of the slider valve is connected to a recoil spring which sits within a chamber that abuts the internal chamber, referred to as a recoil spring chamber. The slider trigger chamber, the internal chamber, and the recoil spring chamber are provided with openings on the portions that are aligned with each such that the slider valve can slide through when moving from a closed to an open position, and vice versa.

In the slider valve example, the slider valve is generally in the closed position wherein the portion of the slider valve with the opening is within the slider trigger chamber. To activate the bottle spout in a drinking position, the trigger is pressed inward which slides the slider valve inward and moves the opening on the slider valve over the hollow opening in the internal chamber. The other side of the slider valve slides into the recoil chamber by pushing into the recoil spring. With the opening on the slider valve positioned over the hollow opening in the internal chamber, the user may have an uninhibited, full flow of a beverage within a connected commercial bottle. Releasing the pressure on the trigger uncoils the recoil spring and automatically returns the slider valve back into the closed position.

Another example of a valve that can be configured in the bottle spout implements a wafer valve which opens downward. The wafer valve is designed to be securely placed and connected within the internal chamber, relatively near an upper end of the internal chamber so that the wafer valve can fully open downward unobstructed. The wafer valve is generally in the form of a flat plate and defined to have the same shape and size of the hollow opening in the internal chamber. One end of the wafer valve is connected to an trigger and a pair of coil springs are integrated at the point where the wafer valve and the external trigger are connected. To activate the bottle spout in a drinking position, the trigger is pressed inward which pushes the valve downward. Releasing the pressure off the trigger returns the valve automatically to a closed position due to the recoil mechanism of the coil spring.

Another example of a valve that can be configured in the bottle spout implements a wafer valve which opens upward. The wafer valve is designed to be securely placed and connected within the internal chamber, relatively near a lower end of the internal chamber so that the wafer valve can fully open upward unobstructed. The wafer valve is generally in the form of a flat plate and defined to have the same shape and size of the hollow opening in the internal chamber. One end of the wafer valve is connected to an trigger and a pair of coil springs integrated at the point where the wafer valve and the external trigger are connected. To activate the bottle spout in a drinking position, the trigger is pressed inward which pushes the valve upward. Releasing the pressure off the trigger returns the valve automatically to the closed position due to the recoil mechanism of the coil spring.

Alternative embodiments exist for each bottle spout with the different valves. Embodiments include an alternative bottle connector coupler which attaches to other existing standard beverage containers, such as and not limited to cans, wide-mouth tea and health drink bottles, soda and coffee cups, corked champagne bottles, and non-threaded wine bottles. Embodiments also include bottle connector couplers that can attach to existing industry non-standard beverage containers such as and not limited to custom beer, wines and coffee bottles, and existing sport bottles. Other non-limiting embodiments include a bottle spout that may be constructed in a variety of shapes, colors, materials, and incorporate embellishments such as and not limited to logos, designs, engravings, glowing and/or lighting elements, key chain loops or straps, audio/visual tracking technologies, and Bluetooth/GPS tracking devices.

Figure 1B:
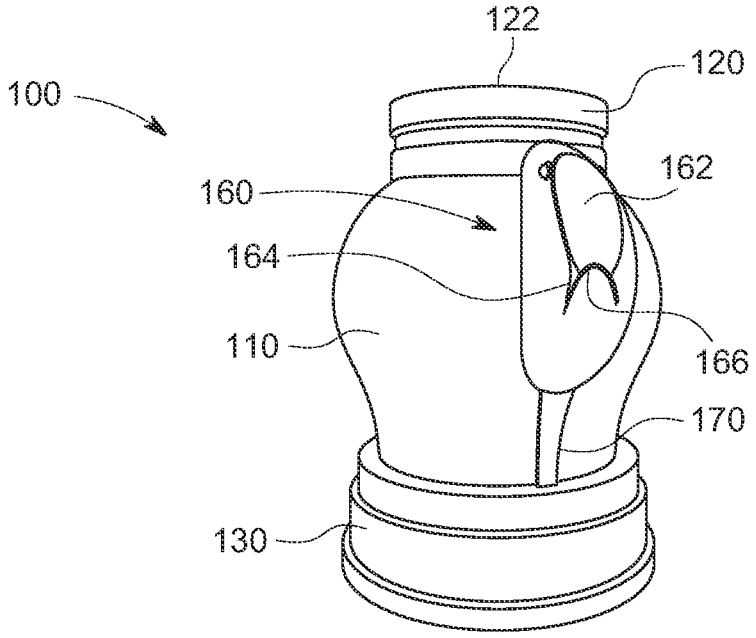
FIG. 1B is a perspective view of the exemplary embodiment of a bottle spout showing the carry clip.
Figure 2A:
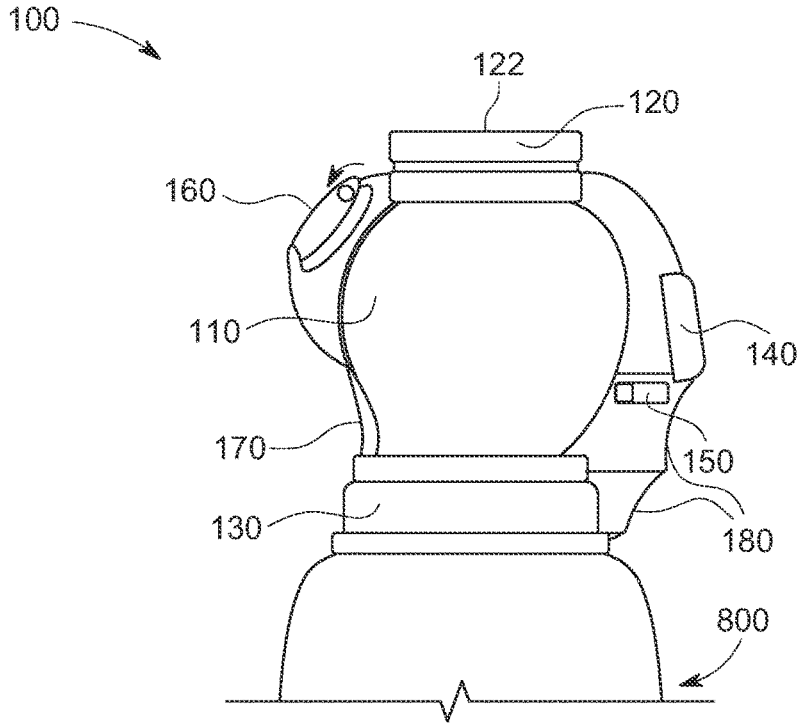
FIG. 2A is a side view of the exterior of the bottle spout.

Referring to the figures, several embodiments of a bottle spout are illustrated. The bottle spout is generally designated to be attached to a commercial bottle. The bottle spout can also be integrated or built onto a commercial bottle. The bottle spout can be constructed in a variety of shapes and sizes while adhering to the basic design with the features that define the benefits and the advantages of the bottle spout disclosed herein. Referring to FIGS. 1A, 1B, and 2A, a non-limiting exemplary embodiment of a bottle spout is illustrated and referred to as bottle spout 100. In FIG. 1A, an exterior of the bottle spout 100 is shown to be comprised of a housing coupler 110, an orifice lip 120, an orifice 122, a bottle connector coupler 130, a trigger 140, a safety lock 150, and a finger rest 180. The bottle spout 100 is also comprised of a carry clip 160 and a thumb rest 170, as illustrated in FIG. 1B. In FIG. 2A, the non-limiting exemplary embodiment of the bottle spout 100 is illustrated as attached to a beverage container 800.

Figure 2B:
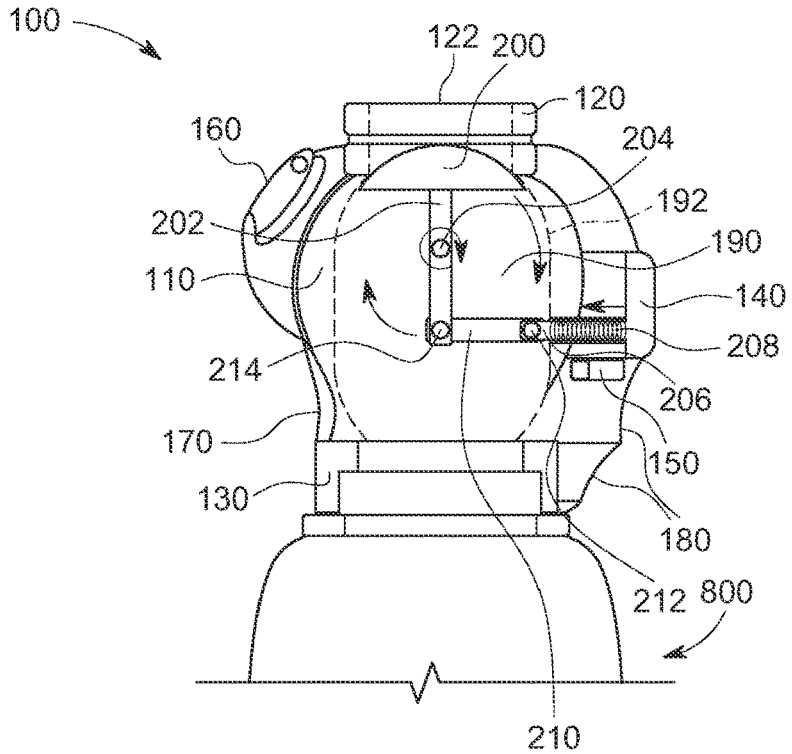
FIG. 2B is a side view of the bottle spout illustrating the semi-ball valve and the corresponding spring-loaded recoil mechanism.

The bottle spout 100 is also comprised of an internal chamber 190 enclosed within the housing coupler 110 (shown in FIG. 2B). Additionally, the bottle spout is also comprised of a valve and a spring-loaded recoil mechanism (not shown in FIGS. 1A and 1B), where several variations of valve types and corresponding spring-loaded recoil mechanisms can be used. Examples of three valve types and spring-loaded recoil mechanisms are shown in FIGS. 2 to 4.

The housing coupler 110 has a first end and a second end, wherein the first end is open and comprised of the drinking orifice lip 120 and the second end is comprised of the bottle connector coupler 130. The drinking orifice lip 120 is the end from which a user drinks the beverage and is thus designed with a smooth rounded edge for the user to comfortably place their mouth. The bottle connector coupler 130 is designed so that it can be connected on to the industry standard bottles by the user. In the preferred embodiment, the bottle connector coupler 130 is designed to be a universal connector such that it can be connected onto several different bottles types and is thus reusable.

Figure 5:
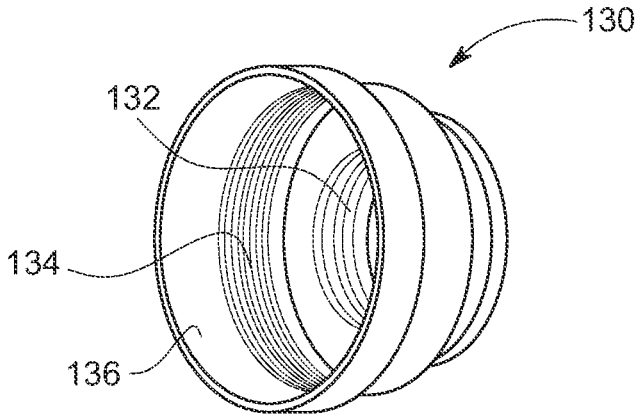
FIG. 5 is a bottom perspective view of one embodiment of the bottle connector coupler.

The bottle connector coupler 130 is configured to fit most commercially available bottles. FIG. 5 illustrates a close-up view of the bottle connector coupler 130, which can be attached to various bottle types by matching the threads of the male commercial bottle to the female bottle connector coupler 130. In this preferred embodiment, the bottle connector coupler is comprised of at least two different female thread and size attachments and a rubber sleeve. The topmost or inner most thread of attachment includes a small thread attachment 132, the middle attachment includes a large thread attachment 134, and the last attachment is a rubber sleeve 136. The two different female threads conform to the male threads on most commercially available bottles. The rubber sleeve 136 is a stretchy rubber coupler at the bottom of the bottle connector coupler 130 which allows the bottle connector coupler to be connected to bottles that do not have threads. By applying pressure on the rubber sleeve 136, the coupler is slipped onto and stretched over an opening of a commercially available bottle and allows the bottle spout to fit snugly over the bottle opening. It is noted that in other embodiments, the coupler may be made other materials other than rubber or in combination with rubber.

In one or more non-limiting embodiments, alternate configurations of a bottle connector coupler are included. One example of a bottle connector coupler is comprised of two different threads for two different bottles. Another example of a bottle connector coupler is comprised of a rubber sleeve only. Another example of a bottle connector coupler is comprised of a single thread configured to fit one bottle neck size with male threads. Other examples of a bottle connector coupler also exist and are comprised of a single coupler that can fit individual standard and non-standard beverage container, such as and not limited to cans, wide-mouth tea and health drink bottles, soda and coffee cups, corked champagne bottles, and non-threaded wine bottles.

The bottle spout 100 is comprised of the internal chamber 190 which is configured within the housing coupler 110, which is shown in FIG. 2B. The figure also illustrates a valve and its corresponding spring-loaded recoil mechanism, which will be discussed later as part of the variety of valve types that can be used. FIG. 2B is referred to for drawing attention to the internal chamber within the housing coupler 110 which is designed to be hollow and traverses the length of the housing coupler 110 from the first end to the second end. The internal chamber 190 is open from the first end with the orifice lip 120 to the second end with the bottle connector coupler 130 which connects to the commercial bottle. The internal chamber 190 is designed to allow a full flow of beverage from the connected commercial bottle 800 through the internal chamber to the open first end with the orifice lip 120.

In one or more embodiments, housing coupler 110 via the internal chamber 190 provides a housing to contain a valve that may be opened to achieve uninhibited flow of a beverage and an auto-close mechanism to close this same valve and to stop uninhibited-flow of beverage. It will be appreciated by those of ordinary skill in the art that this design may also accommodate a free-flow nozzle which may allow unimpeded flow of the beverage through the spout and flow without requiring sucking, pumping, or squeezing of the bottle. The valve, in the several examples detailed later, is designed to close the opening within the internal chamber 190, generally near the first end with the orifice lip 120. The valve in the examples listed below is connected to the trigger 140 through the valve's corresponding spring-loaded recoil mechanism. The trigger 140 is designed onto the exterior of the housing coupler 110.

To activate the opening of the valve, the user can press into (or down, depending on the trigger) the trigger 140, which in turn opens the valve through the spring-loaded recoil mechanism, and exposes the opening in the internal chamber 190 and the attached bottle. It is noted that a user need only use one hand to press on the trigger 140 and activate the valve to open. Once the pressure is released (i.e. the user removes his or her hand off of the trigger 140), the valve is automatically returned back to the closed position and seals the opening through the automatic spring-loaded recoil mechanism. It will be appreciated by those of ordinary skill in the art that the design of the valve mechanism achieves the benefit of preventing spillage when the valve is closed.

Referring back to FIG. 1A, the bottle spout 100 is also comprised of the safety lock mechanism 150. A preferred embodiment of the safety lock mechanism 150 is comprised of a rotating disc on an axle (internal mechanism not shown in the figures). Depending on the type of valve used, the rotating disc includes a pin that extends vertically upward from the disc or alternatively a pin that extends horizontally outward from the pin. The safety mechanism 150 is configured to be positioned near the trigger 140 such that a part of the disc extends out from the housing coupler 110 and with the axel and pin positioned inside the housing coupler 110. To activate the safety lock 150, the disc is manually rotated counterclockwise which rotates the pin on the disc to be positioned against the trigger 140 on the inside of the housing coupler 110 and thus blocking the external trigger from being pushed inward or downward. To unlock the safety lock 150, the disc is rotated in the opposite direction, clockwise, to rotate the pin away and unblocking the external trigger.

In the preferred embodiment, the bottle spout 100 is also comprised of the carry clip 160, as shown in a close-up view in FIG. 1B. The carry clip 160 is integrated onto the exterior surface of the housing coupler 110. In the preferred embodiment, the carry clip 160 is designed to function much like a traditional bent clip, such as a carabiner, and allows the user to quickly attach the bottle spout 100 to other items such as and not limited to a carry strap, a belt loop, a lunch/tote bag, or a key chain for ease of carrying. The carry clip 160 has a gate 162, which is the part that opens, and snaps shut. The exterior top end of the gate 162 is connected to the housing coupler 110. A portion that runs along the housing coupler 110 and is opposite the gate 162 is a spine 164. The gate 162 snaps into a nose 166 of the carry clip 160 and is the portion that closes the loop. To use the carry clip 160, the user would press into the gate 162 toward the spine 164 to push the gate 162 away from the nose 166. The user would then hook the bottle spout 100 to an item by slipping it into the space created by pushing the gate 162 away from the nose 166. Releasing the gate 162 would allow the gate 162 to snap back to the nose 166 and securely attach to the item. The carry clip 160 can be made of plastic or metal or any material known in the arts. It can also be appreciated that other carry clip designs can be integrated onto the bottle spout.

As shown in FIG. 1A and FIG. 2B, the bottle spout 100 is also comprised of an ergonomic design which allows the user to comfortably hold and use the bottle spout 100 and an attached bottle with one hand. The ergonomic attributes include and are not limited to the thumb rest 170 on a side opposite the trigger 140, at least one finger rest 180 designed below the trigger 140, and a smooth orifice lip 120. This design allows the user to comfortably hold the bottle spout 100 with the connected commercial bottle and activate the valve mechanism in a single motion with the same hand by pressing the trigger 140 with a finger and then drinking from the smooth orifice lip 120. The bottle spout 100 can also be configured with a variety of grips and handles that conform to and adapt the basic need of a full-flow drinking spout which has a user-initiated trigger and valve mechanism which can be activated in a single motion with one hand while picking up the beverage, and which closes automatically when the user-initiated trigger is released.

The bottle spout 100 as discussed earlier can be equipped with a variety of valve types including and not limited to a semi-ball valve, a ball valve, a slider valve, a wafer valve that opens downward, a wafer valve that opens upward, and other valves that can be accommodated and fitted within the internal chamber of the bottle spout. The semi-ball valve, the ball valve, and the slider valve are described in more detail as examples of valves incorporated in the bottle spout to further illustrate the function and advantage of the bottle spout.

Example 1—Semi-Ball Valve

In the first example, the valve comprising a part of the bottle spout is in the shape of a semi-ball, which is illustrated in FIG. 2B and referred to as a semi-ball valve 200.

The semi-ball valve 200 is situated within the internal chamber 190 and is designed to cover the opening to the orifice lip 120. The semi-ball valve 200 is connected to the external trigger 140 through a spring recoiled mechanism. The spring recoiled mechanism is comprised of the semi-ball valve 200 connected to a rod, referred to as a valve rod 202. The valve rod 202 has a central axle 204, which is located generally near the center of the valve rod 202. The trigger 140 is connected to a shaft, referred to as a plunger shaft 206. The plunger shaft 206 is wrapped around with a recoil spring 208 which is pushed up against an exterior surface of a chamber wall 192 of the internal chamber 190. An end of the plunger shaft 206 which is within the internal chamber 190 and opposite the trigger 140 is connected to another shaft, referred to as a linkage arm 210. The linkage arm 210 connects to the valve rod 202, and thus may be thought of as connecting the trigger 140 to the semi-ball valve 200. The two ends of the linkage arm 210 are connected to the plunger shaft 206 and the valve rod 202 via a pair of linkage pins 212 and 214, one at each end, respectively.

To activate the rotation to open the orifice on the bottle spout, the trigger 140 is depressed, which forces the connected plunger shaft 206 inward. When the user presses on the trigger 140 with a finger, the inward motion of the plunger shaft 206 pushes on the linkage arm 210 and deviates the angle at the linkage pin 212 connecting the plunger shaft 206 to the linkage shaft 210 and further causing the linkage arm 210 to move upward. This upward movement deviates the angle at the linkage pin 214 connecting the linkage arm 210 to the valve rod 202 which causes the valve rod 202 to rotate at the central axle 204 which rotates the semi-ball valve 200 away from the opening at the orifice lip 120 of the bottle spout 100. Applying the pressure on the trigger 140 also causes the recoil spring 208 to be compressed. While the pressure is placed on the trigger 140 by the user, the semi-ball valve 200 stays displaced from the opening at the orifice lip 120. Removing the finger off the trigger 140 removes the pressure, and the recoil spring 208 decompresses and causes the automatic return of the semi-ball valve 200 over the opening at the orifice lip 120, essentially following the opposite movement of the valve rod 202, the linkage arm 210, and the plunger shaft 206.

Example 2—Ball Valve

Figure 3A:
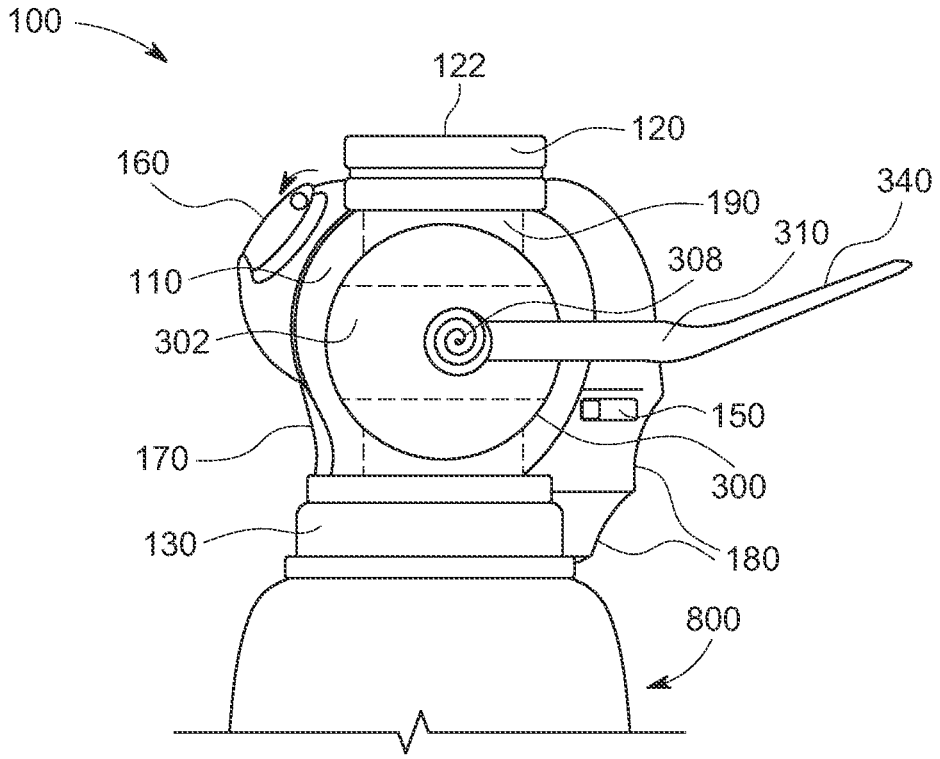
FIG. 3A is a side view of the bottle spout illustrating the ball valve and the corresponding spring-loaded recoil mechanism.
Figure 4:
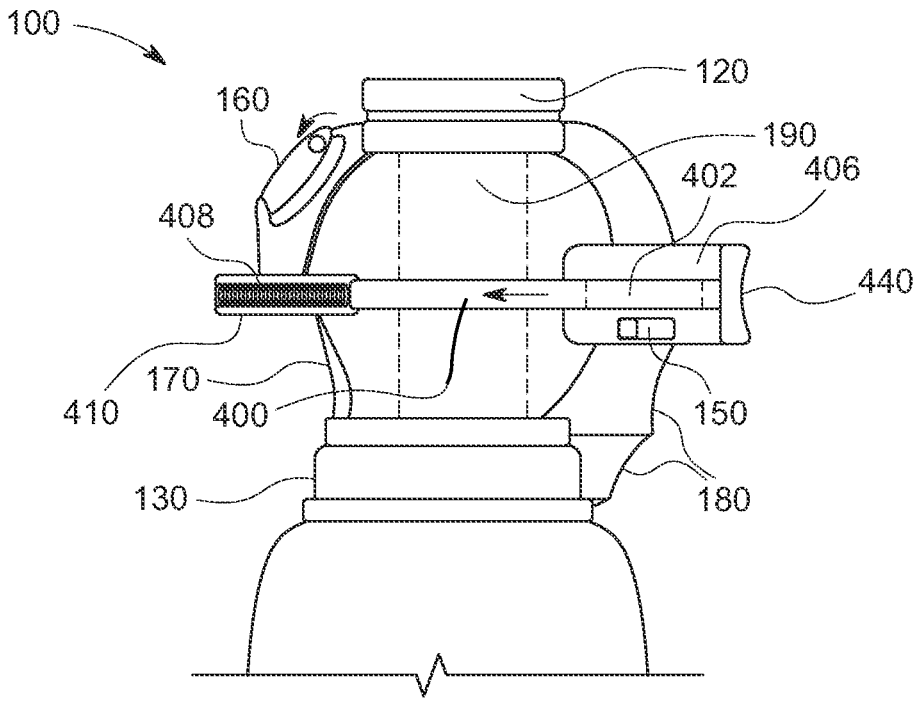
FIG. 4 is a side view of the bottle spout illustrating the slider valve and the corresponding spring-loaded recoil mechanism.

Another example of a valve that can be incorporated within the housing of the bottle spout 100 is the rotating ball valve 300, which is illustrated in FIG. 3A. The rotating ball valve 300 is housed within a spherical internal chamber 190 of the housing coupler 110. The internal chamber 190 is designed to accommodate the ball valve 300 snugly, which creates a tight seal, but at the same time allows the ball valve 300 to rotate within the internal chamber 190. The internal chamber, as described earlier, is open on the two ends of the housing coupler 110, the first end and the second end, which are open to the orifice lip 120 and the bottle housing coupler 130, respectively. The ball valve 300 is comprised of a hollow core 302 which traverses through the middle of the ball valve 300. The hollow core 302 is designed to be approximately the same diameter as the openings in the two ends of the internal chamber 190, which are approximately the same diameter as the opening at the orifice 122 and the opening at the bottle connector coupler 130. When the openings in the hollow core 302 of the ball valve 300 and the openings in the internal chamber 190 align with each other, it provides an uninhibited free flow of the beverage from a connected commercial bottle 800.

The ball valve 300 generally rests in a closed position, which is when the hollow core 302 is not aligned with the openings in the internal chamber 190 and is relatively perpendicular to these openings. In this configuration, the ball valve 300 provides a tight seal to prevent the flow of the beverage through to the orifice 122 of the bottle spout.

Figure 3B:
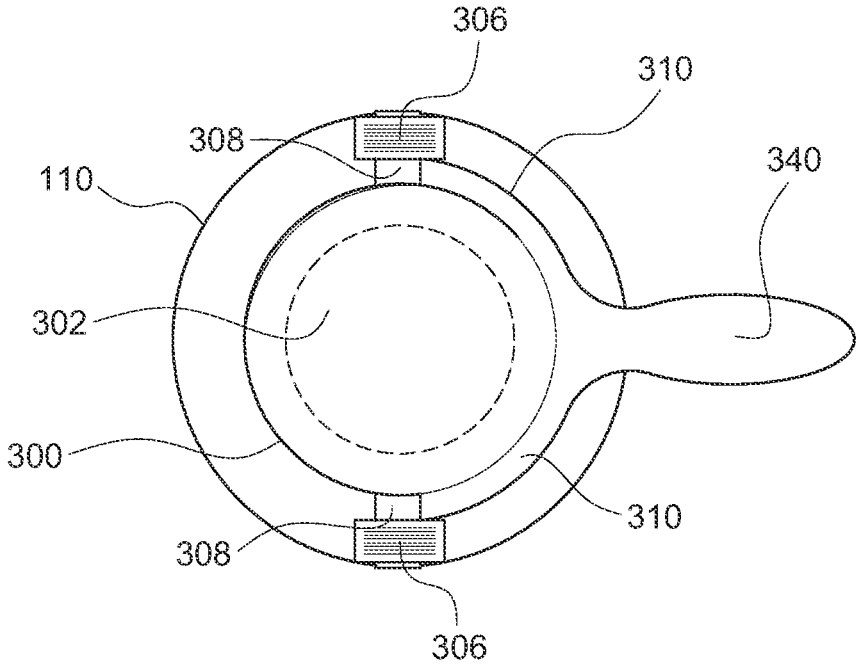
FIG. 3B is an internal view from the top of the bottle spout illustrating the ball valve and the corresponding spring-loaded recoil mechanism.

Referring to FIGS. 3A and 3B, the ball valve 300 utilizes a spring recoil mechanism that rotates the ball valve 300 and automatically returns it to the closed position. FIG. 3B is top cut view illustrating the ball valve, the spring-loaded recoil mechanism, and the connected external trigger. The ball valve 300 is connected to and rotates on an axle, referred to as a ball axle 308. The ball axle 308 is integrated with a pair of coil springs 306, one on each side of the ball valve. A trigger 340 is connected to the ball valve 300 such that a pair of linkage arms 310 extend from the trigger 340 and connect to the ball axle 308. The trigger 340 is a flat piece that extends outward through an opening in the housing coupler 110. The housing coupler 110 is designed with a slot (not shown in the figure) that extends downward from the opening for the trigger 340. The slot may be described as an open section which can accommodate a downward movement of the trigger 340. The trigger 340 is pressed down along the slot which rotates the ball axle 308 via the connected linkage 310 arms which in turn rotates the ball valve 300 to the position which aligns the hollow core 302 of the ball valve 300 with the openings in the internal chamber 190, the connected commercial bottle, and the opening at the orifice 122. In this position, the user is capable of drinking the beverage from the bottle spout with an uninhibited, full flow. Releasing the pressure off the trigger 340 automatically returns the ball valve 300 to the closed position via the action of the coil springs 306 on each end of the ball axle 308, thus preventing flow of beverage.

Example 3—Slider Valve

Another example of a valve that can be implemented in the bottle spout 100 includes a slider valve 400, as illustrated in FIG. 4. The slider valve 400 is fashioned as a flat plate and includes an opening 402 on one side that is the same shape and diameter as the opening in the internal chamber 190. A trigger 440 is connected to the slider valve 400 on the side that has the opening 402. The portion of the slider valve 400 connected to the trigger 440 sits within a chamber, referred to as slider trigger chamber 406. The other side of the slider valve 400 is connected to a recoil spring 408 which sits within a chamber that abuts the internal chamber 190, referred to as a recoil spring chamber 410. The slider trigger chamber 406, the internal chamber 190, and the recoil spring chamber 410 are provided with openings (not shown) on the portions that are aligned with each other such that the slider valve 400 can slide through these chambers when moving from a closed to an open position, and vice versa.

In the slider valve example, the slider valve 400 is generally in the closed position wherein the portion of the slider valve with the opening is within the slider trigger chamber 406. To activate the bottle spout 100 in a drinking position, the trigger 440 is pressed inward which slides the slider valve 400 inward and moves the opening 402 on the slider valve 400 into the hollow opening of internal chamber 190. The other side of the slider valve 400 slides into the recoil spring chamber 410 by pushing into the recoil spring 408. With the opening 402 on the slider valve 400 aligned with the hollow opening in the internal chamber 190, the user may have an uninhibited, full flow of a beverage within a connected commercial bottle 800. Releasing the pressure on the trigger 440 uncoils the recoil spring 408 and automatically returns the slider valve 400 back into the closed position.

Figure 6:
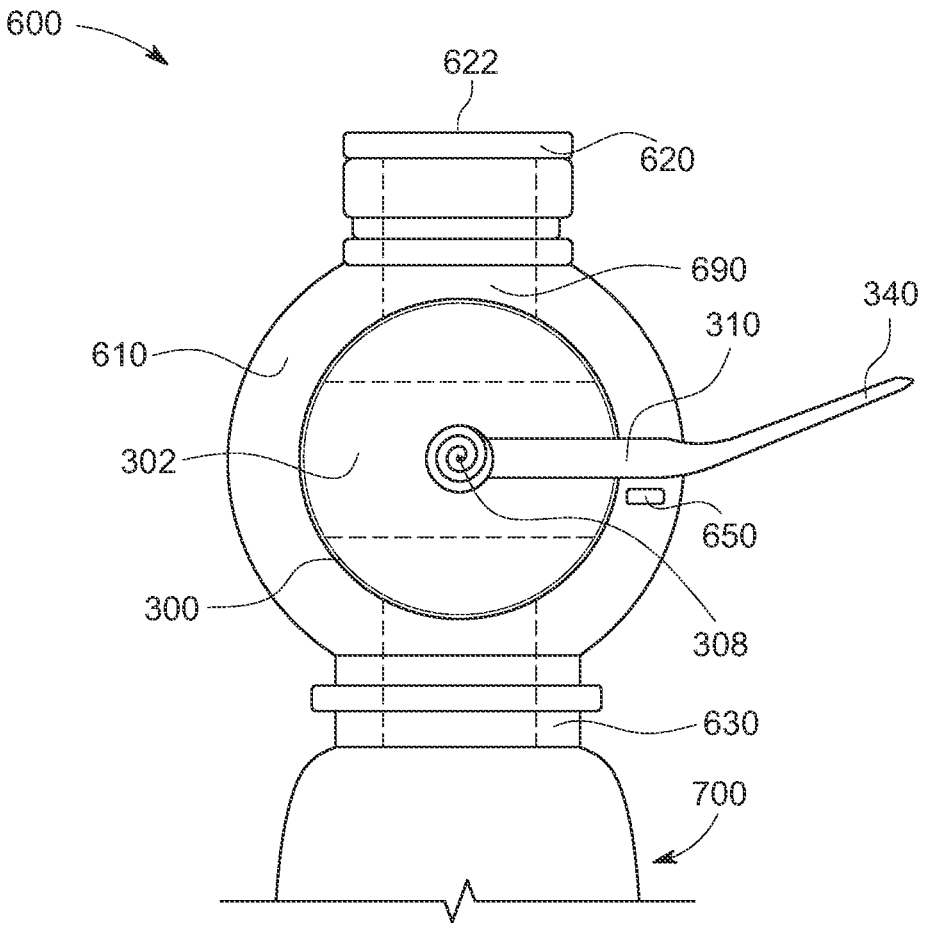
FIG. 6 is a side view of an alternate embodiment of a bottle spout manufactured onto a bottle.

FIG. 6 also illustrates an alternate embodiment of a bottle spout, such as bottle spout 600. The bottle spout 600 in this embodiment is illustrated having a more rounded shape and is comprised of all the same features, including housing coupler 610, an orifice lip 620, an orifice 622, a trigger 340, an internal chamber 690, and a safety lock 650. The bottle spout in this embodiment does not include a thumb rest, a carry clip, and a finger rest, however other embodiments of this bottle spout 600 can be comprised of these additional features. The bottle spout 600 is designed to be built onto a bottle, such as bottle 700. The bottle spout 600 is comprised of a bottle connector coupler 630 which is built onto and is an extension of a neck (not shown) of the bottle 700 such that the bottle spout 600 and the bottle 700 are seamlessly integrated to be a part of each other. In FIG. 6, the ball valve 300 and the corresponding spring-loaded recoil mechanism (detailed above) is shown. However, the bottle spout 600 which is built onto the bottle 700 is not limited to the ball valve 300, and other valve types and their corresponding spring-loaded recoil mechanisms are also included in alternate embodiments. These valve types include and are not limited to the semi-ball valve, the slider valve, the wafer valve that opens upward, and the wafer valve that opens downward.

Accordingly, the present description provides one or more embodiments for a useful drinking spout with multiple benefits. It may be an advantage of the drinking spout, as described herein in one or more embodiments, that a user is able to drink from a beverage using one hand rather than two hands in order to open and close an accompanying lid with every sip. The exemplary drinking spout also prevents spilling of the beverage, which means the drinking spout can help save electronics, keyboards, important documents, or other gadgets and possessions from being ruined or spoiled by spilling of one's beverage. Additionally, the exemplary drinking spout allows one to resume drinking his or her beverage at a later time, which is particularly useful for people who do not generally drink the entire bottle or can or beverage all at once. In addition, the exemplary drinking spout as described herein may offer further sanitation by preventing dust, dirt, bugs, or any unwanted item or contaminants from accidentally falling into one's drink.

In addition to the above, the exemplary drinking spout is unique in that it may provide significant safety benefits for people who drive, cycle, or operate heavy machinery by allowing the person to keep one hand where needed and still be able to take a drink with the other hand. This exemplary drinking spout may also be very useful for children who tend to have trouble opening their beverages and/or tend to spill. The exemplary drinking spout, as described herein, is also advantageously reusable and easy to clean. In one or more embodiments, the exemplary drinking spout may come in a variety of colors, sizes, and shapes, and may include different design features. Thus, the drinking spout, as described in one or more non-limiting embodiments throughout this document, offers an improved method and device for drinking one's beverage and offers multiple advantages over other existing lids or closing mechanisms that are currently available.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A spout attached bottle comprising:

a bottle spout non-removably integrated as part of a non-threaded bottle, the bottle spout comprising a housing having a drinking end and a bottle connection end, the housing including:

an open drinking orifice proximally located at the drinking end;

a bottle connector coupler proximally located at the bottle connection end and manufactured directly onto a bottle drinking orifice;

a chamber fluidly connecting the bottle connection end and the drinking end, the chamber containing:

an internal valve selectably adjustable between: (1) an open position permitting fluid to pass internally through the chamber between bottle connection end and the drinking end and (2) a closed position preventing fluid from passing internally through the chamber between the bottle connection end and the drinking end; and an internal spring mechanically coupled to the valve and providing a force holding the valve in the closed position by default;

a trigger mechanically connected to the valve and the spring, that, when activated, both: (1) overcomes the spring force holding the valve and (2) moves the valve into the open position; and wherein when the trigger is deactivated the spring force returns the valve to the closed position.

2. The bottle of claim 1, the bottle further comprising a neck and wherein the bottle connector coupler is built onto and is an extension of the neck.

3. The bottle of claim 1, wherein the valve is a semi-ball valve.

4. The bottle of claim 1, wherein the valve is a ball valve with a hollow core that extends through the valve and the hollow core has a diameter that is similar to the diameter of the chamber.

5. The bottle of claim 1, wherein the valve is a wafer valve that opens downward, such that the wafer valve opens away from the drinking orifice.

6. The bottle of claim 1, wherein the valve is a wafer valve that opens upward, such that the wafer valve opens toward the drinking orifice.

7. The bottle of claim 1, wherein the valve is a slider valve, and the slider valve is generally configured as a flat plate with an opening similar in diameter to the chamber, such that the trigger pushes the opening in the slider valve to align with the chamber.

8. The bottle of claim 1, wherein the open drinking orifice is a threaded open drinking orifice; and further comprising a threaded cap threaded onto the threaded open drinking orifice.

9. The bottle spout of claim 1, wherein the system includes a lock to prevent the trigger from opening the valve.

10. The bottle spout of claim 1, wherein the trigger is configured to be activated via one hand and to close automatically when the one hand is released from the trigger.

11. The bottle of claim 1, wherein the housing comprises a thumb rest and at least one finger rest.

12. A spout attached bottle comprising:

a bottle spout non-removably integrated as part of a non-threaded bottle, the bottle spout comprising a housing having a drinking end and a bottle connection end, the housing including:

an open drinking orifice located at the drinking end;

a bottle connector coupler proximally located at the bottle connection end and manufactured directly onto a bottle drinking orifice;

an internal chamber fluidly connecting the bottle connection end and the drinking end, the internal chamber containing;

a valve selectably adjustable between: (1) an open position permitting fluid to pass internally through the chamber between a connected bottle drinking orifice and the open drinking orifice and (2) a closed position preventing fluid from passing internally through the chamber between the connected bottle drinking orifice and the open drinking orifice; and a spring mechanically coupled to the valve and providing a force holding the valve in the closed position by default;

a trigger mechanically connected to the valve and the spring, that, when activated, both: (1) neutralizes the spring force holding the valve and (2) moves the valve into the open position; and wherein when the trigger is deactivated the spring force returns the valve to the closed position.

13. The bottle of claim 12, wherein the valve is a semi-ball valve that is completely displaced from the open drinking orifice.

14. The bottle of claim 12, wherein the valve is a ball valve with a hollow core that extends through the valve and the hollow core has a diameter that is similar to the diameter of the chamber.

15. The bottle of claim 12, wherein the valve is a wafer valve that opens downward, such that the wafer valve opens away from the open drinking orifice.

16. The bottle of claim 12, wherein the valve is a wafer valve that opens upward, such that the wafer valve opens toward the open drinking orifice.

17. The bottle of claim 12, wherein the valve is a slider valve, and the slider valve is generally configured as a flat plate with an opening similar in diameter to the chamber, such that the trigger pushes the opening in the slider valve to align with the chamber.

18. The bottle of claim 12, wherein the trigger is selected from among a push trigger, a press trigger, or and a squeeze trigger.

19. The bottle of claim 12, wherein the bottle spout includes a lock to prevent the trigger from opening the valve.

20. The bottle of claim 12, the bottle further comprising a neck and wherein the bottle connected coupler is built onto and is an extension of the neck.

* * * * *